United States Patent [19]

Bishop

[11] Patent Number: 4,702,453

[45] Date of Patent: Oct. 27, 1987

[54] UNIVERSALLY POSITIONABLE BOOK HOLDER

[76] Inventor: John A. Bishop, 156 Williamsburg Ct., Albany, N.Y. 12203

[21] Appl. No.: 777,000

[22] Filed: Sep. 17, 1985

Related U.S. Application Data

[63] Continuation-in-part of Ser. No. 559,737, Dec. 9, 1983, Pat. No. 4,620,687.

[51] Int. Cl.[4] ..... A47B 97/04

[52] U.S. Cl. ..... 248/447.2; 248/452

[58] Field of Search ..... 248/447.2, 441.1, 442.2, 248/447, 447.1, 451, 452, 453, 481, 231.7, 288.5, 288.3, 278; 281/45

[56] References Cited

U.S. PATENT DOCUMENTS

| | | | |
|---|---|---|---|
| 376,593 | 1/1888 | Greenawalt | 248/447.2 X |
| 1,692,337 | 11/1928 | Forbes | 248/447.2 X |
| 2,422,877 | 6/1947 | Anderson | 248/452 |
| 2,694,538 | 11/1954 | Consolo et al. | 248/231.7 X |
| 2,807,908 | 10/1957 | Lykes | 248/451 |
| 3,377,117 | 4/1968 | Biscow | 248/481 X |
| 3,905,573 | 9/1975 | Davis | 248/447.2 X |
| 3,981,522 | 9/1976 | Bloom | 248/451 X |
| 4,548,375 | 10/1985 | Moss | 248/205.2 |

*Primary Examiner*—J. Franklin Foss

*Attorney, Agent, or Firm*—Christopher B. Garvey

[57] ABSTRACT

A universally positionable holder securely holds a book or other printed matter in any position. A selectively shaped back plate has a frontal lip at its lower portion and straps, secured at its upper portion. The straps are extendable across the front of the back plate to bend around the bottom to the back, where they are secured to the plate by hook and loop type fasteners. Hold-down stays are pivotably mounted near the top of the back plate and attachment means are provided on the back of the back plate. The back plate is attached via a double ball-joint to a universally positionable support arm comprised of arm segments and joints, mounted upon a base that may be mounted either by clamp or by screws.

8 Claims, 5 Drawing Figures

FIG.1
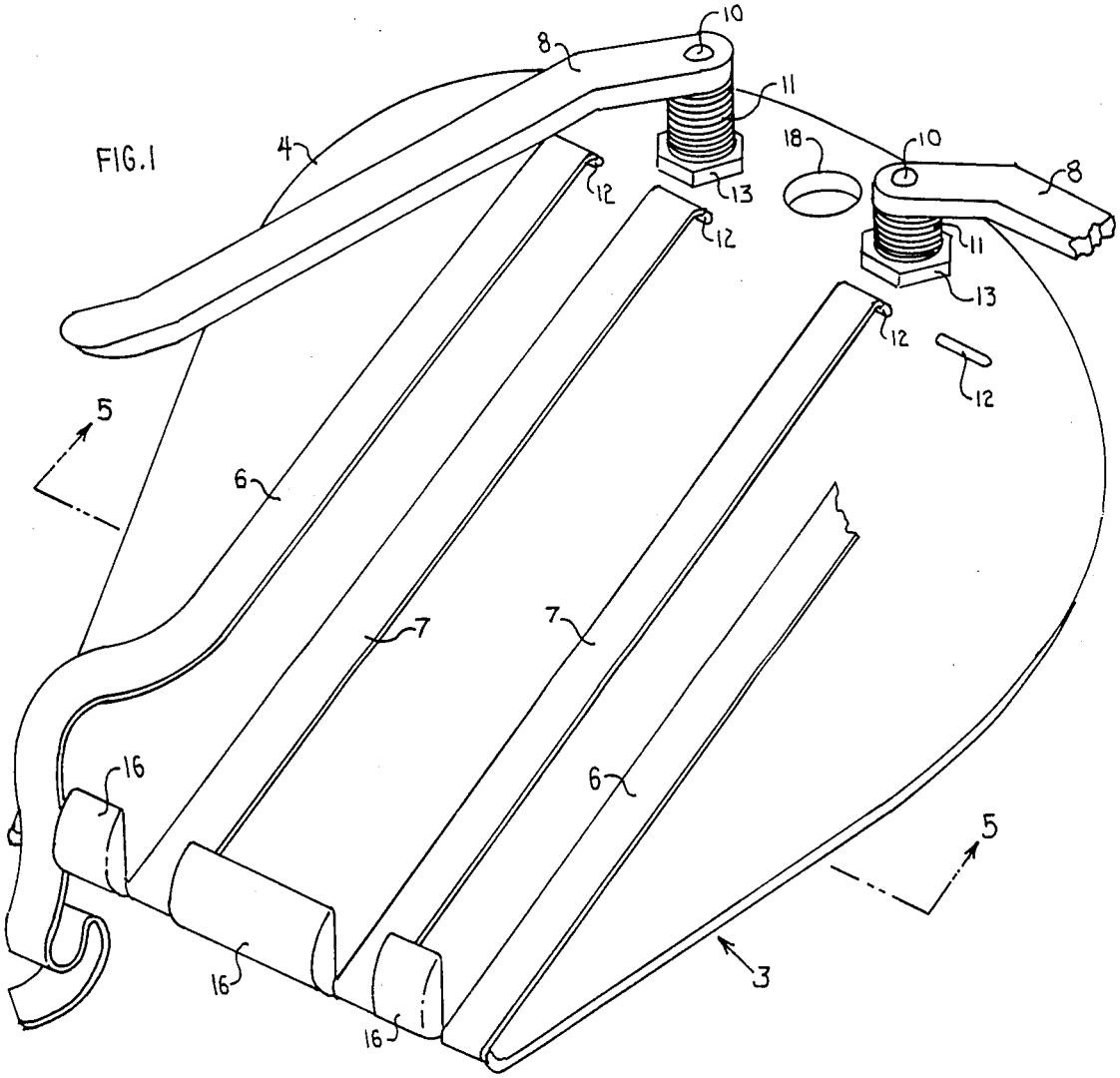
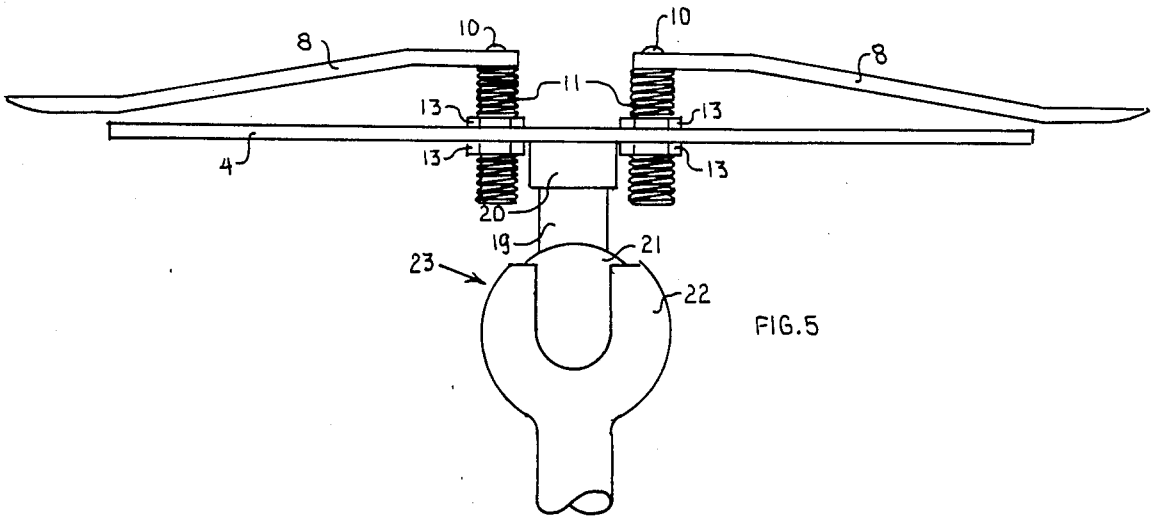
FIG.5

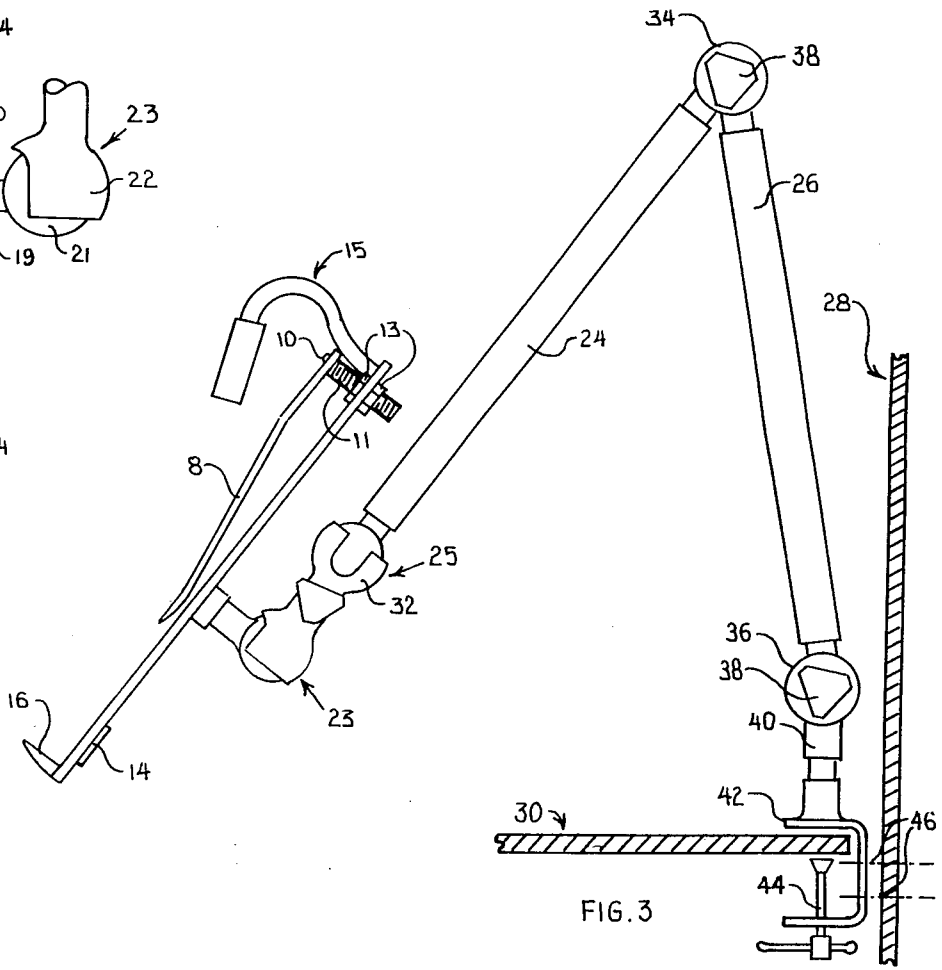
FIG. 3
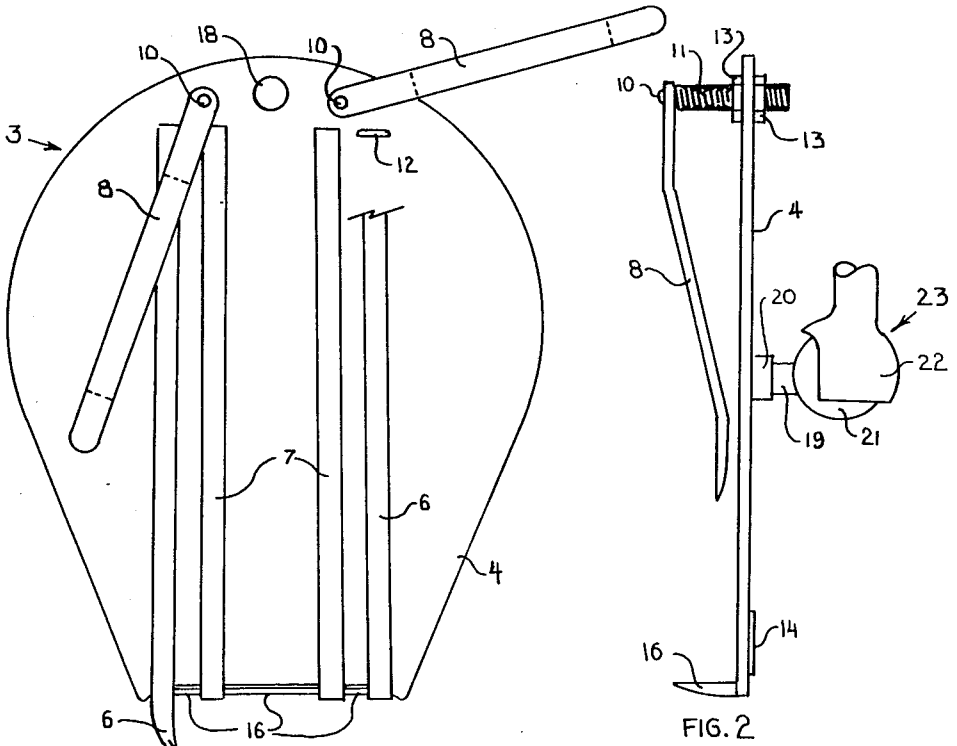
FIG. 2
FIG. 4

UNIVERSALLY POSITIONABLE BOOK HOLDER

This application is a continuation-in-part of application Ser. No. 559,737, filed Dec. 9, 1983, now U.S. Pat. No. 4,620,687. Priority is claimed from that date on any subject matter that is common to these two applications.

BACKGROUND OF THE INVENTION

The present invention relates to facilitating the reading process and allowing the user to free his or her hands and desk space for purposes other than holding the printed material. Stands for supporting printed matter are old in the art, for example, music stands, lecterns, and typing stands. The present invention provides a holder for printed matter which may be useful where a floor or desk surface is unavailable for supporting printed matter. Anyone who reads should find it useful.

SUMMARY OF THE INVENTION

To accomplish the foregoing and other objects of this invention there are three main parts to the invention: a back plate assembly, a support assembly and a base member. First, the back plate assembly is the part which attaches to the book or other printed matter and holds the book securely from the cover or spine via two straps. Two stays hold a book or other printed matter open at the desired page. The straps are secured near the top of the back plate and held firm against the back plate by hook and loop type fasteners near the bottom of the back of the back plate. The stays may be plastic or metal and may be prebiased towards the back plate. One end of each stay is mounted on one of two pedestals projecting perpendicularly from the surface of the back plate. The stays are secured upon their respective pedestals pivotably in a plane parallel to the back plate by means of fasteners such as screws or rivets which are capable of frictionally resisting but not preventing such pivoting movement of said stays. Said stays can he adjusted side to side to the desired angle for maximum effectiveness in stabilizing the open pages.

The back plate is held in place by a double ball-joint which attaches to the back plate. The double ball-joint allows rotation of the back plate in any direction and said joint may have provision to be adjusted for desired friction.

The ball-joints are mounted upon an arm segment which is mounted upon a third joint. Said third joint is pivotable in a plane containing the axis of the first arm segment and a second arm segment. The second arm is mounted on a fourth joint. The fourth joint provides a hinge pivotable in a single plane similarly to the third joint. The fourth joint is rotatably mounted on a base member which serves as a mounting means. The third and fourth joints, which may be described as elbow joints, are toothed and each is adjustable upon loosening a knobbed screw.

The base member can be fastened to a wall via screws or to a suitable piece of furniture such as a desk, table or bed via a clamp.

BRIEF DESCRIPTION OF THE DRAWINGS

FIG. 1 is an oblique view of the back plate assembly.

FIG. 2 is a side view of the back plate assembly.

FIG. 3 is a side view of the entire invention.

FIG. 4 is a front view of the back plate assembly.

FIG. 5 is a detail of the ball joint assembly showing the back plate in section.

DETAILED DESCRIPTION

FIG. 1 shows a back plate assembly, generally designated 3, of the present invention comprising a back plate 4, four restraining straps 6, two page hold-down stays 8, and two fastening pins 10 which screw into threaded pedestals 11 (shown better in FIGS. 2, 3 & 5) which attach the hold-down stays 8 to the back plate 4 either in threaded engagement with the back plate or by means of nuts 13 which screw on the threads of the pedestals to clamp them onto the back plate. This allows vertical adjustment of the hold-down stays 8.

Located on the back plate 4 are four anchor slots 12, near the top of said back plate 4. Said anchor slots 12 are integrally formed through the back plate 4. Passing through the anchor slots 12 are restraining straps 6, 7. Each strap may be secured to its anchor slot 12 by passing an end of the strap from front to back and tying a stopper knot in that end on the back side of the back plate. The straps 6, 7 are preferably VELCRO or other such hook-and-loop type material strips or may be straps with VELCRO pads located at the free end opposite the anchor slots. Restraining straps 6, 7 are preferably relatively inelastic. Straps 6, 7 can be passed over a book, bent around the bottom of the plate, and secured by hook and loop fastener to VELCRO pads 14 (shown in FIGS. 2 & 3) located on the reverse side of the back plate. This arrangement provides for adjustment of the length of straps 6 attachable thereto as may be appropriate for the particular size of the printed matter. Straps 7 may be stretched across the cover leaves of a book or the cover and several pages of a magazine to capture its spine and hold the book or magazine to the back plate 4. Outer straps 6 may be stretched across the bulk of additional pages to add strength to the hold-down stay 8, especially where the printed material is more than a couple of hundred pages and is being used in an inverted position. The back plate 4 also has a multi-section lip 16 at its bottom to prevent downslipping of the printed matter and to more securely hold the printed matter without any give due to loose fastening of the restraining straps 6. Straps 7 pass through the spaces between the sections of lip 16. A hole 18 at the top of the back plate 4 provides for easy mounting of a lighting assembly 15 (shown in FIG. 3).

FIG. 2 shows a side view to show the pedestals 11 which keep the hold down stays 8 elevated above the back plate 4 and shows a sleeve 20 which is part of the back plate 4. A rod 19 fits into ball 21 which fits in a socket 22. Said ball 21 and socket 22 comprise a universal ball-joint 23.

FIG. 3 shows another side view which shows how universal ball-joint 23 is part of a truck 32 which is part of another universal ball-joint 25 which is attached to arm segments 24, 26 which are then attached to a wall 28 or table top 30. Arm segment 24 is attached to elbow joint 34 which is attached to another arm segment 26 which is attached to another elbow joint 36 which is rotatably attached, possibly via post means such as 40 to a mounting means 42. Mounting means 42 may comprise a standard clamp 44 for securing to a table top 30 or bed (not shown). Said mounting means 44 incorporates screw holes 46 for being secured to a wall 28 or other solid object. Elbow joints 34, 36 are preferably adjustable via interlocking teeth by screw means 38.

FIG. 4 shows a front view of the back plate assembly 3.

FIG. 5 shows a side view from the top of the back plate 4 and shows the ball-joint 23.

I claim:

1. A universally positionable book holder comprising a selectively shaped back plate having:

a multisection frontal lip at its lower portion;

four relatively secure strap attachment means near an upper portion of the back plate;

four quickly releasable strap attachment means on the back of the back plate;

four relatively inelastic straps affixed to the relatively secure attachment means on the upper portion of the back plate, which straps may be pulled downwardly and bent around a lower end of the back plate and secured to the quickly releasable strap attachment means;

a pair of stays pivotably mounted near the top of said back plate, on threaded pedestals, said pedestals comprising means for vertical adjustment of the stays;

attachment means on the back of said back plate;

a universally positionable support means attached to the attachment means on the back of said back plate.

2. A device according to claim 1 in which the quickly releasable attachment means comprise hook-and-loop type fasteners.

3. A device according to claim 2 wherein said universally positionable support means comprise:

ball means, affixed to the back plate and mounted within socket means, said ball and socket comprising ball joint means;

said socket, affixed to a second socket containing a second ball, said second ball a socket comprising a second ball joint means;

said second ball joint means affixed to a first arm segment;

said first arm segment attached to a third joint means;

said third joint means attached to a second arm segment;

said second arm segment attached to a fourth joint means;

said fourth joint means rotatably attached to a mounting means.

4. A device according to claim 3 in which the mounting means comprises a base assembly having both clamp means and screw hole means.

5. A device according to claim 4 on which a reading lamp is mounted at the upper portion of the plate.

6. A universally positionable book holder comprising:

a selectively shaped plate, having:

a length designed to be parallel to a spine of a book to be held, and a width, perpendicular thereto;

and having:

a front, a back, and along its elongated dimension:

an upper portion; and a lower portion including a lower end, a shape which is substantially flat at its lower end and which, above said flat, curves out to its maximum width and from its maximum width curves inward to a curved upper end;

a three section frontal lip protruding from the lower end;

four attachment points near the upper portion of the back plate suitable for attaching strap means to;

four relatively inelastic lengthwise strap means capable of being affixed to said upper portion of the back plate and having hook-and-loop type fastening means at the free end of the strap means;

spaces between the sections of the lip which allow the strap means to be extended across the front of the back plate, through said spaces and around the bottom of the back plate and attached to hook-and-loop type fastening means on the back of the back plate;

page hold down means in the form of two stays pivotably mounted near the top of said plate on threaded pedestals, said pedestals comprising means for vertical adjustment of the stays;

attachment means on the back of said plate for attachment to support means comprising a threaded screw means;

ball means, affixed to the plate and mounted within socket means, said ball and socket comprising ball-joint means;

a second socket affixed to the first, having a second ball mounted within said ball and socket comprising a second ball-joint means;

said second ball-joint means attached via a first arm segment to third joint means;

said third joint means attached via a second arm segment to a fourth joint means;

said fourth joint means rotatably attached via a post to a mounting means;

said mounting means having both clamp means and screw hole means of being fastened to a surface.

7. A device according to claim 6 having provision for attachment of a reading lamp.

8. A device according to claim 7 having an adjustable reading lamp.

* * * * *